US011064730B2

(12) United States Patent
Guyard et al.

(10) Patent No.: US 11,064,730 B2
(45) Date of Patent: Jul. 20, 2021

(54) HYDROPHOBIC CAPSULE

(71) Applicant: PHILIP MORRIS PRODUCTS S.A., Neuchatel (CH)

(72) Inventors: Aurélien Guyard, Orbe (CH); Laurent Lavanant, Evian-les Bains (FR); Yves Jordil, Lausanne (CH)

(73) Assignee: Philip Morris Products S.A., Neuchâtel (CH)

( * ) Notice: Subject to any disclaimer, the term of this patent is extended or adjusted under 35 U.S.C. 154(b) by 211 days.

(21) Appl. No.: 16/307,867

(22) PCT Filed: Jun. 28, 2017

(86) PCT No.: PCT/IB2017/053871
§ 371 (c)(1),
(2) Date: Dec. 6, 2018

(87) PCT Pub. No.: WO2018/011660
PCT Pub. Date: Jan. 18, 2018

(65) Prior Publication Data

US 2019/0297937 A1 Oct. 3, 2019

Related U.S. Application Data

(60) Provisional application No. 62/360,923, filed on Jul. 11, 2016.

(51) Int. Cl.
*A24D 3/06* (2006.01)
*A24D 3/14* (2006.01)
(Continued)

(52) U.S. Cl.
CPC ..... *A24D 3/061* (2013.01); *A24D 1/20* (2020.01); *A24D 3/14* (2013.01); *A24D 3/17* (2020.01); *A24F 7/04* (2013.01)

(58) Field of Classification Search
CPC ..... A24D 3/061
See application file for complete search history.

(56) References Cited

U.S. PATENT DOCUMENTS 4,251,195 A 2/1981 Suzuki et al.
6,214,376 B1 4/2001 Gennadios
(Continued)

FOREIGN PATENT DOCUMENTS

CN 102895926 1/2013
CN 102933105 2/2013
(Continued)

OTHER PUBLICATIONS

International Search Report and Written Opinion for PCT/IB2017/053871, issued by the European Patent Office, dated Oct. 16, 2017; 12 pgs.
(Continued)

*Primary Examiner* — Eric Yaary
(74) *Attorney, Agent, or Firm* — Mueting Raasch Group

(57) ABSTRACT

A capsule (120) for use in a smoking article includes a liquid sensory enhancing material; and a shell surrounding the liquid sensory enhancing material. The shell has an outer surface rendered hydrophobic by hydrophobic groups covalently bond to the outer surface of the shell. The shell may be rendered hydrophobic by reacting hydroxyl groups at outer surface of the shell with fatty acid halides to covalently attach fatty acid moieties to the surface of the capsule.

4 Claims, 5 Drawing Sheets

(51) Int. Cl.

| | |
|---|---|
| ***A24F 7/04*** | (2006.01) |
| ***A24D 1/20*** | (2020.01) |
| ***A24D 3/17*** | (2020.01) |

(56) References Cited

U.S. PATENT DOCUMENTS

| | | | | |
|---|---|---|---|---|
| 8,663,671 | B2 | 3/2014 | Karles et al. | |
| 2004/0191366 | A1 | 9/2004 | Mangos | |
| 2005/0079215 | A1 | 4/2005 | Schleifenbaum | |
| 2005/0112154 | A1* | 5/2005 | Giroud ..... | A61K 8/19 424/401 |
| 2013/0236647 | A1 | 9/2013 | Samain et al. | |
| 2017/0055569 | A1 | 3/2017 | Becker et al. | |

FOREIGN PATENT DOCUMENTS

| | | | |
|---|---|---|---|
| CN | 105536658 | | 5/2016 |
| EA | 011475 | B1 | 4/2009 |
| EA | 013725 | B1 | 6/2010 |
| EP | 0 389 700 | A1 | 10/1990 |
| KZ | 29188 | B | 11/2014 |
| WO | WO 2003/055587 | A1 | 7/2003 |
| WO | WO 2004/050069 | A1 | 6/2004 |
| WO | WO 2006/082529 | A2 | 8/2006 |
| WO | WO 2006/136197 | A1 | 12/2006 |
| WO | WO 2007/060543 | A2 | 5/2007 |
| WO | WO 2010/146845 | A1 | 12/2010 |
| WO | WO 2011/117733 | A1 | 9/2011 |
| WO | WO 2013/098405 | A2 | 7/2013 |
| WO | 101512 | | 7/2015 |
| WO | WO 2016/063181 | A1 | 4/2016 |
| WO | WO 2016/063182 | A1 | 4/2016 |

OTHER PUBLICATIONS

International Preliminary Report on Patentability for PCT/IB2017/053871, dated Jan. 24, 2019 by the International Bureau of WIPO; 7 pgs.

Russian Decision to Grant issued for RU Application No. 2018145759 dated Jul. 16, 2020; 11 pgs. including English Translation.

Chinese Office Action for CN201780037951.8 issued by the China National Intellectual Property Administration dated Dec. 18, 2020; 22 pgs. including English translation.

* cited by examiner

HYDROPHOBIC CAPSULE

This application is the § 371 U.S. National Stage of International Application No. PCT/IB2017/053871, filed 28 Jun. 2017, which claims the benefit of U.S. Provisional Application No. 62/360,923, filed 11 Jul. 2016.

The present disclosure relates to capsules for use in smoking articles where the capsules are treated to be hydrophobic and to filters, mouthpieces, and smoking articles that include the hydrophobic-treated capsules.

Filter cigarettes typically comprise a rod of tobacco cut filler surrounded by a paper wrapper and a cylindrical filter aligned in end-to-end relationship with the wrapped tobacco rod, with the filter attached to the tobacco rod by tipping paper. In conventional filter cigarettes, the filter may consist of a plug of cellulose acetate tow wrapped in porous plug wrap. Filter cigarettes with multi-component filters that comprise two or more segments of filtration material for the removal of particulate and gaseous components of the mainstream smoke are also known.

A number of smoking articles in which an aerosol forming substrate, such as tobacco, is heated rather than combusted have also been proposed in the art. In heated smoking articles, the aerosol is generated by heating the aerosol forming substrate. Known heated smoking articles include, for example, smoking articles in which an aerosol is generated by electrical heating or by the transfer of heat from a combustible fuel element or heat source to an aerosol forming substrate. During smoking, volatile compounds are released from the aerosol forming substrate by heat transfer from the heat source and entrained in air drawn through the smoking article. As the released compounds cool, they condense to form an aerosol that is inhaled by the consumer. Also known are smoking articles in which a nicotine-containing aerosol is generated from a tobacco material, tobacco extract, or other nicotine source, without combustion, and in some cases without heating, for example through a chemical reaction.

It is known to incorporate flavorant additives into smoking articles in order to provide additional flavors to the consumer during smoking. Flavorants may be used to enhance the tobacco flavors produced upon heating or combusting the tobacco material within the smoking article, or to provide additional non-tobacco flavors such as mint or menthol.

The flavorant additives used in smoking articles, such as menthol, are commonly in the form of a liquid flavorant which is incorporated into the filter or the tobacco rod of the smoking article using a suitable liquid carrier. Liquid flavorants are often volatile and will therefore tend to migrate or evaporate from the smoking article during storage. The amount of flavorant available to flavor the mainstream smoke during smoking is therefore reduced.

It has previously been proposed to reduce the loss of volatile flavorants from smoking articles during storage through the encapsulation of the flavorant, for example, in the form of a capsule or microcapsule. The encapsulated flavorant may be released prior to or during smoking of the smoking article by breaking open the encapsulating structure, for example by crushing or melting the structure. Where such capsules are crushed to release the flavorant, the capsules break open at a particular force and release the flavorant.

In many smoking articles incorporating a capsule, the capsule may absorb humectant, water and other compounds found in the mainstream smoke or aerosol passing through the smoking article, or humidity or moisture surrounding the capsule. The absorbed liquid may decrease the structural integrity of the capsule and cause inadvertent leaking of flavorant or breaking of the capsule.

It would therefore be desirable to provide a novel breakable capsule that is less prone to inadvertent leakage or breakage under high moisture conditions. For example, it would be desirable to provide a smoking article having a mechanically stable capsule when the smoking article includes a high humectant level, a high moisture content, or is stored in a high moisture environment.

According to a first aspect of the invention, a capsule for used in a smoking article comprises a liquid sensory enhancing material and a shell surrounding the liquid sensory enhancing material. The shell comprises an outer surface that is rendered hydrophobic. Preferably, the outer surface is rendered hydrophobic by covalently binding hydrophobic groups to the outer surface of the shell. Preferably, the hydrophobic groups comprise fatty acids moieties or esters thereof.

According to another aspect of the invention, a smoking article comprises the capsule that is rendered hydrophobic. The capsule may be incorporated into the smoking article downstream of an aerosol forming substrate.

In yet another aspect of the invention, a method for manufacturing capsules having a hydrophobic outer surface includes reacting a reactive group on the surface of the capsule with a fatty acid halide. The reactive group preferably comprises a pendant hydroxyl moiety. Preferably, the fatty acid halide reacts with the hydroxyl moiety to form a fatty acid ester moiety.

Hydrophobic capsules in smoking articles may absorb less water or humectant in the smoke or aerosol passing through the smoking article. As a result, the likelihood of premature or inadvertent leakage or breakage of the capsule may be reduced. Similarly, the likelihood of premature or inadvertent leakage or breakage of the capsule may be reduced when the smoking articles are stored in high humidity environments (e.g., relative humidity greater than 70%, 80%, 90%, 95%, 99% or when the smoking article is stored for an extended period, such as more than three weeks, two months, three months, or six months, or a combination of such conditions) or when the smoking articles include high moisture content or high humectant content in, for example, the aerosol-generating substrate.

Capsules of the present invention are treated to be made hydrophobic and thus may, under certain circumstances, be more mechanically stable than capsules that are not treated to be made hydrophobic. Accordingly, the hydrophobic and mechanically stable capsules may be better able to maintain one or more of their performance characteristics such as resistance to click, distance at breakage, tactile and audible sensations when compressed to breakage, and resistance to premature breakage or leakage.

Any suitable capsule may be made hydrophobic in accordance with the teachings of the present disclosure. Preferably, the capsule includes an outer shell encapsulating a liquid composition. The liquid composition may comprise a sensory enhancing agent. As used herein, the term "comprising" means including, but not limited to the one or more enumerated components. It will be understood that the terms "consisting of" and "consisting essentially of" are subsumed within the term comprising. Accordingly, a liquid composition that comprises a sensory enhancing agent may be a liquid composition that consists essentially of, or consists of, the sensory enhancing agent.

The capsule may be formed in a variety of physical formations including, but not limited to, a single-part capsule, a multi-part capsule, a single-walled capsule, a multi-walled capsule, a large capsule, and a small capsule.

The shell of the capsule may be formed from any suitable material. For example, the shell may comprise a starch, such as a degraded or chemically or physically modified starch such as starch esters and ethers (in particular dextrins and maltodextrins); a gelatin; collagen; chitosan; a lecithin; gellan gum; agar; agarose; alginic acid; an alginate; a carrageenan; a pectin; arabic gum; ghatti gum; pullulan gum; curdlan; mannan gum; inlunin; xanthan gum; a modified and non-modified cellulose more particularly cellulose esters and ethers, for example cellulose acetate, ethyl cellulose, hydroxy-propyl cellulose, hydroxypropyl methyl cellulose and carboxymethyl cellulose; synthetic membrane materials such as polymers including one or more of polyacrlyates, polyvinyl alcohol, and polyvinyl pyrrolidone; alone or as a mixture thereof. The shell may contain any suitable amount of the one or more materials, such as from about 1.5% w/w to about 100% w/w, such from about 4% w/w to about 75% w/w, or from about 20% w/w to about 50% w/w of the total dry weight of the shell.

The shell may further include one or more fillers. As used herein, a "filler" is any suitable material that may increase or decrease the percentage of dry material in the shell, or change the viscoelastic properties of the shell, such as a plasticizer. Increasing the dry material amount in a shell may result in solidifying the shell, and in making the shell physically more resistant to deformation. Preferably, the filler is selected from the group comprising starch derivatives such as dextrin, maltodextrin, cyclodextrin (alpha, beta or gamma), or cellulose derivatives such as hydroxypropylmethylcellulose (HPMC), hydroxypropylcellulose (HPC), methylcellulose (MC), carboxymethylcellulose (CMC), polyvinyl alcohol, polyols or mixture thereof. The amount of filler in the shell is generally 98.5% or less, such as from about 25% to about 95%, from about 40% to about 80%, or from about 50% to about 60% by weight of the total dry weight of the shell.

The capsule may be formed as described in, for example, published International Patent Application No. WO2006/136197, entitled SMOKING DEVICE INCORPORATING BREAKABLE CAPSULE, BREAKABLE CAPSULE AND PROCESS FOR MANUFACTURING SAID CAPSULE. WO2006/136197 describes, among other things, the shell may comprise a gellan in an amount from 1.5 to 50% w/w of the total weight of the shell. Alternatively, the capsule may be formed as described in, for example, published International Patent Application No. WO2010/146845, entitled SOFT CAPSULE AND MANUFACTURING METHOD THEREFOR. Alternatively, the capsules may be formed as described in US 2017/0055569, which describes, among other things, a shell comprising polyvinyl acetate. Alternatively, the capsules may be prepared as described in, for example, EP 0389700 A1; U.S. Pat. Nos. 4,251,195; 6,214,376; WO 2003/055587; or WO 2004/050069.

The capsules may comprise finely dispersed liquid or solid phases coated with film-forming polymers. The polymers may be deposited onto the material to be encapsulated after, for example, emulsification and coacervation or interfacial polymerization. Alternatively, a liquid sensory enhancing agent may be absorbed in a matrix that may be coated with one or more film-forming polymers.

Preferably, the shell comprises one or more pendant hydroxyl moieties on the outer surface of the shell or is treated to include one or more pendant hydroxyl moieties on the outer surface of the shell. The pendant hydroxyl moieties may be provided by the one or more hydrocolloids, the one or more filler, or both. In addition or alternatively, the shell may comprise one or more additive that provides the one or more hydroxyl group. Suitable treatments for forming pendant hydroxyl moieties on the outer surface of the shell include plasma treatment or corona treatment. The concentration or density of hydroxyl groups may be controlled by controlling the composition of the shell or the type or extent of treatment of the shell.

The capsule may be treated in any suitable manner to make the outer surface of the shell hydrophobic. Preferably, the capsule is treated to covalently bond hydrophobic groups to the outer surface of the shell. The hydrophobic surface may be formed by reacting the surface with any suitable reagent or reagents comprising the hydrophobic groups. Preferably, the hydrophobic groups are covalently bonded to the outer surface of the shell or pendent protogenic groups on the outer surface of the shell. For example, the hydrophobic group may be covalently bonded to pendent hydroxyl groups of the outer surface of the shell.

A covalent bond between moieties of the outer surface of the shell and the hydrophobic reagent may form hydrophobic groups that are more securely attached to the shell than simply disposing a coating of hydrophobic material on the outer surface of the shell.

The hydrophobic reagent may comprise an acyl group or fatty acid group. The acyl group or fatty acid group or mixture thereof may be saturated or unsaturated. A fatty acid group, such as a fatty acid halide, in the reagent may react with pendent protogenic groups, such as hydroxyl groups, of the shell to form a covalent bond, such as an ester bond, between, for example, the fatty acid and the shell. In essence, these reactions with the pendant hydroxyl groups may esterify the cellulosic material.

Preferably, the acyl group or fatty acid group includes a $C_{10}$-$C_{30}$ alkyl (an alkyl group having from 10 to 30 carbon atoms), a $C_{12}$-$C_{24}$ alkyl (an alkyl group having from 14 to 24 carbon atoms) or preferably a $C_{16}$-$C_{20}$ alkyl (an alkyl group having from 16 to 20 carbon atoms). In some examples, a capsule is modified to covalently bond moieties comprising fatty acids of more than one length. Those skill in the art would understand that the term "fatty acid" as used herein refers to long chain aliphatic, saturated or unsaturated fatty acid that comprises 12 to 30 carbon atoms, 14 to 24 carbon atoms, 16 to 20 carbon atoms or that has greater than 15, 16, 17, 18, 19, or 20 carbon atoms. In various embodiments, the hydrophobic reagent includes an acyl halide, a fatty acid halide, such as, a fatty acid chloride including palmitoyl ($C_{16}$) chloride, stearoyl ($C_{18}$) chloride, behenoyl ($C_{22}$) chloride, or a mixture thereof, for example. For example, the hydrophobic reagent may include a mixture of palmitoyl chloride and stearoyl chloride. A reaction between fatty acid chloride and a pendant hydroxyl group on the outer surface of the shell results in a bound fatty acid ester moiety and hydrochloric acid.

A reagent comprising hydrophobic moieties may be bound to the shell in any suitable manner. For example, the shell may be exposed to a vapour comprising the reagent at a suitable temperature for a suitable time for the reagent to react with a reactive group on the shell. For example, a capsule having a shell comprising pendant hydroxyl groups may be exposed to a vapour comprising a fatty acid halide at a temperature of about 80° C. to about 100° C. for about 2 minutes to about 10 minutes to attach the fatty acid moiety to the surface via an ester bond. The vapour may be carried in a suitable gas stream, such as a nitrogen gas stream enriched with the vapour.

Alternatively, the reagent comprising the hydrophobic moiety may be dissolved in a suitable solvent and the solvent may be applied by, for example, dipping, spraying, printing, or otherwise contacting to the shell to react with pendant reactive moieties on the shell at a suitable temperature and for a suitable time. The reagent may be dissolved in any suitable solvent. For fatty acid halides, the solvent is preferably a nonprotic polar solvent, such as acetone or acetonitrile.

In another example, an amount of reagent comprising a hydrophobic moiety may be deposited without solvent at the surface of shell at controlled temperature, for example, droplets of the reagents forming 20-micrometer regularly-spaced circles on the surface. The control of the vapour tension of the reagent may promote the propagation of the reaction by diffusion with the formation of ester bonds between fatty acid and the shell while continuously withdrawing unreacted acid chloride. The esterification of the pendant hydroxyl groups of the shell is in some instances, based on the reaction of pendent hydroxyl groups on the surface of the shell with an acyl halide, such as an acyl chloride including a fatty acid chloride. The temperature that may be used to heat the hydrophobic reagent depends on the chemical nature of the reagent and for fatty acid halides, it ranges from about 120° C. to about 180° C. However, the temperature that may be used may be limited by the nature of the shell of the capsule. In some preferred embodiments, the reaction temperature is in a range from about 80° C. to about 100° C.

Preferably the hydrophobic capsule is formed by reacting a reagent comprising a fatty acid group, such as a fatty acid halide, with pendent hydroxyl groups on the shell of the capsule to form a hydrophobic surface of the capsule. Hydrophobic fatty acyl groups may be attached to the surface of the shell by reacting a fatty acid halide (such as chloride, for example) with pendent hydroxyl groups on the shell to form a hydrophobic surface of the capsule. The fatty acid halide may be applied by loading the fatty acid halide in liquid form onto a solid support, such as a brush, a roller, or an absorbent or non-absorbent pad, and then contacting the solid support with a surface of the capsule. The fatty acid halide may also be applied by printing techniques, such as gravure, flexography, ink jet, heliography, by spraying, by wetting, or by immersion in a liquid comprising the fatty acid halide. The applying step may deposit discrete islands of reagent forming a uniform or non-uniform pattern of hydrophobic areas on the surface of the capsule. The uniform or non-uniform pattern of hydrophobic areas on the wrapper may be formed of at least about 100 discrete hydrophobic islands, at least about 500 discrete hydrophobic islands, at least about 1000 discrete hydrophobic islands, or at least about 5000 discrete hydrophobic islands. The discrete hydrophobic islands may have any useful shape such as a circle, rectangle or polygon. The discrete hydrophobic islands may have any useful average lateral dimension. In many embodiments, the discrete hydrophobic islands have an average lateral dimension in a range from 5 to 100 micrometres, or in a range from 5 to 50 micrometres. To aid diffusion of the applied reagent on the surface, a gas stream may also be applied. Apparatus and processes such as those described in US patent application publication number 20130236647, incorporated herein by reference in its entirety, may be used to produce the hydrophobic capsule.

In some embodiments, a stream of heated fatty acid halide or other suitable hydrophobic reagent may flow across a bed of capsules to graft the hydrophobic reagent to the capsules, for example, by reacting a fatty acid chloride with a hydroxyl group on the surface of the capsule. In some embodiments, the temperature of the stream is between 70° C. and 170° C. It will be understood that the reaction temperature may be dependent on, among other things, one or both of the vapor pressure of the hydrophilic reagent and a temperature at which the integrity of the shell is compromised. The bed of capsules may, or may not, be preconditioned by heating at the appropriate temperature prior to introducing the stream of heated hydrophobic reagent.

The hydrophobic reagent, such as a fatty acid halide, may be carried by a carrier gas, such as nitrogen or air. The flow rate of the stream may be constant or may be varied. For example, the flow rate may be low for relatively long durations interspersed with short duration high flow rates to permit levitation of the capsules. The hydrophobic reagent may be placed on blotter paper, which may be placed at the bottom of a column containing the capsules. The carrier gas may be flowed through the column to cause the FAC to interact with the capsules. The carrier gas may be preheated prior to introduction to the column. In addition, or alternatively, the hydrophobic reagent may be heated, for example in a water bath, and heated vapor of the hydrophobic reagent may be combined with carrier gas for introduction into a column containing capsules. The carrier gas may be preheated prior to combining with the hydrophobic reagent vapor.

In either case (blotting paper or heat-produced hydrophobic reagent vapor), gas may be vented, for example via the carrier gas stream, from the column to allow reaction by-products, such as hydrochloric acid if the reaction is between a fatty acid chloride and a surface hydroxyl moiety.

Following grafting, the capsules may be allowed to cool passively or may be subjected to staged cooling. Stage cooling may entail exposing capsules in the column to successively reduced temperatures of heated air, nitrogen or water vapor. For example, the temperature of the heated air, nitrogen or water vapor may be cooled by 20° C. or any other suitable staged temperature reduction with each successive cooling stage.

In some embodiments, the capsule may be contacted with a suitable hydrophobic reagent, such as a fatty acid halide, in a suitable solvent, such as petroleum ether, and heated in an oven or with a heat gun at a suitable temperature and time to graft the reagent to the surface of the capsule. The time at which the capsules are heated to allow grafting of the reagent may be limited if extended periods of heating may compromise the integrity or performance of the capsule. Preferably, capsules coated with the hydrophobic reagent are heated for about 2 minutes to about 20 minutes; more preferably from about 4 minutes to about 8 minutes. Depending on the nature of the hydrophobic reagent, solvent (if used), and the capsule, heating may be from between about 70° C. and about 170° C.

The capsule may have any suitable shape, such as spherical, oval or cylindrical. However, preferably the capsule is spherical. This may include capsules having a sphericity value of at least about 0.9, and preferably a sphericity value of approximately 1. Sphericity is a measure of how spherical an object is. By definition, the sphericity ($\psi$) of an object is the ratio of the surface area of a sphere having the same volume as the given object to the surface area of the object. A perfect sphere has a sphericity value of 1. Preferably, the generally spherical capsule comprises a generally spherical outer shell.

The capsule may contain any suitable sensory enhancing agent. Suitable sensory-enhancing agents include flavorants and sensation agents. Suitable flavorants include natural or synthetic menthol, peppermint, spearmint, coffee, tea, spices (such as cinnamon, clove and/or ginger), cocoa, vanilla, fruit flavors, chocolate, eucalyptus, geranium, eugenol, agave, juniper, anethole, linalool, and any combination thereof. A particularly preferred flavorant is menthol.

The concentration of sensory-enhancing agent in a breakable capsule may be adjusted or modified to provide a desired amount of the sensory-enhancing agent. Thus, the concentration of sensory-enhancing agent within each capsule may be the same or may vary depending on the desired sensory result.

The capsule preferably has a diameter of between about 2 mm and about 7 mm, more preferably between about 3 mm and about 5 mm. In some preferred embodiments, the capsule has a diameter of about 3.5 mm. Alternatively, the capsule may be a microcapsule having a diameter, for example, less than about 1 mm. For example, the microcapsule may have a diameter from about 0.01 mm to about 1 mm.

The shell of the capsule may have any suitable thickness. Microcapsules may have thinner shells than larger capsules. For capsules having a diameter of about 2 mm or more, the shell preferably has a thickness of at least 30 microns, more preferably at least 50 microns to provide an inherent burst strength that is sufficiently high that the capsule may withstand forces during manufacture.

Examples of breakable capsules that may be used in smoking articles of the present invention include mechanically breakable capsules, such as crushable capsules; heat rupturable capsules; microcapsules with diameters of 0.3 mm to 1.0 mm; or macrocapsules with diameters of 1.0 mm to 7.0 mm; and the like. Preferably, the breakable capsules are crushable capsules. As used herein, a crushable capsule is a capsule having a crush strength from about 0.01 kp to about 5 kp, preferably from about 0.5 kp to about 2.5 kp. The crush strength of the capsule may be measured by continuously applying a load vertically onto one capsule until rupture. The crush strength of the capsules may be measured by using a LLOYD-CHATILLON Digital Force Gauge, Model DFIS 50, having a capacity of 25 Kg, a resolution of 0.02 Kg, and an accuracy of +/−0, 15%. The force gauge may be attached to a stand; the capsule may be positioned in the middle of a plate that is moved up with a manual thread screw device. Pressure may then be applied manually. The gauge records the maximum force applied at the very moment of the rupture of the capsule (measured in, for example, Kg or in Lb). Rupture of the capsule results in the release of contents of the core.

Additional methods for characterizing capsules include crush force which is the maximum compressive force measured in, for example, Newtons that a capsule may withstand before breakage; and distance at breakage which is the change in dimension of the capsule due to compression, i.e., deformation, at breakage. It may also be expressed for example by the ratio between a dimension of the capsule (e.g., the capsule diameter) and the dimension of the capsule, measured in the direction of the compression force, when it is compressed to the point of breakage. The compression is generally applied toward the floor by the compression plates of an automatic or manual compression testing machine. Such machines are well known in the art and commercially available.

In preferred embodiments, the capsule has a crush strength prior to introduction into a smoking article of from about 0.6 kp to about 2 kp, preferably from about 0.8 kp to about 1.2 kp. The capsule preferably has a crush strength after introduction into a smoking article and subjected to a smoking test from about 0.6 kp to about 2 kp, more preferably from about 0.8 kp to about 1.2 kp. Alternatively, the capsule has a crush force value prior to introduction into a smoking article of about 10.0 N to about 25.0 N, preferably from about 11 N to about 18 N, and more preferably in the range of about 12.0 N to about 16.0 N. The compression test machine may operate at a range of speed from 10 mm/min to 420 mm/min. For capsules of diameter in the range of about 4 mm to about 7 mm diameter, the capsule prior to introduction into a smoking article may exhibit a distance at breakage of about 0.60 mm to about 0.80 mm, preferably about 0.74 mm. The above crush force (also known as resistance to click) and distance at breakage is typically obtained when a universal tensile/compression testing machine equipped with 100 N tension load cell like, Instron or equivalent, is operating at about 30 mm/min of from about 0.6 kp to about 2 kp, preferably from about 0.8 kp to about 1.2 kp. Preferably, the release element has a maximum resistance to breaking of about 17 N, preferably about 14 N. The above maximum resistance to breaking is typically obtained when a universal tensile/compression testing machine equipped with 100 N tension load cell like, Instron or equivalent, is operating at about 30 mm/min and at 22 degrees Celsius under 60 percent relative humidity. An example of a manual test machine is the Alluris Type FMI—220C2—Digital Force Gauge 0-200N—Supplier: Alluris GmbH & Co.

One or more capsule described in the present disclosure may be incorporated into a smoking article in any suitable manner. Preferably, the capsule is incorporated into a filter or a mouthpiece of the smoking article.

The term "mouthpiece" is used herein to indicate the portion of the smoking article that is designed to be contacted with the mouth of a consumer. The mouthpiece may be defined by the extent of an outer wrapper, such as tipping wrapper. The mouthpiece may, in some instances, be defined as a portion of the smoking article extending about 40 mm from the mouth end of the smoking article, or extending about 30 mm from the mouth end of the smoking article. The mouthpiece may include a filter.

Preferably, the capsule is incorporated into a filter. Preferably, the capsule is embedded in filter material, such as cellulose acetate tow, polylactic acid (PLA), or paper. For example, the filter may be embedded in a filter material in a manner similar to how flavor-containing breakable capsules are incorporated into filters of cigarettes.

Alternatively, the capsule may be placed within a void or cavity in the filter. For example, the capsule may be placed in a cavity in a plug-space-plug configuration with an upstream segment and a downstream segment defining the cavity containing the capsule between them. In some embodiments, the filter includes a transparent wrapper which provides a window overlying the cavity. This may allow a consumer to see the capsule in the cavity. This may be particularly advantageous where the capsule has a visual indicator, which would allow a consumer to establish that the capsule has been broken.

Filters or mouthpieces containing capsules as described in the present disclosure may be attached to a rod, such as a tobacco rod, to form all or at least part of a smoking article. Preferably, the filter or mouthpiece is axially aligned with the rod. In many embodiments, the filter is joined to the tobacco rod with tipping paper.

The filters or mouthpieces containing the capsule may be incorporated in any suitable smoking article. The term "smoking article" is used herein to indicate cigarettes, cigars, cigarillos and other articles in which a smokeable material, such as a tobacco, is lit and combusted to produce smoke. The term "smoking article" also includes an aerosol-generating article in which an aerosol comprising nicotine is generated by heat without combusting the aerosol-forming substrate, such as a tobacco substrate or other nicotine-containing substrate, and includes an aerosol-generating article in which an aerosol comprising nicotine is generated by without combusting or heating the aerosol-forming substrate, for example through a chemical reaction or inhalation of a powder.

Preferably, a smokable material or an aerosol-forming substrate includes a rod of tobacco. For purposes of the present disclosure, "smokable material" and "aerosol-forming substrate" are used interchangeably. The rod may be formed of shredded tobacco or tobacco cut filler, or it may include reconstituted tobacco or cast leaf tobacco, or a mixture of both. The aerosol-forming substrate may be connected to a mouthpiece in an end-to-end relationship.

One example of a heated smoking article includes an aerosol forming substrate that is heated by one or more electrical heating elements to produce an aerosol. In another type of heated smoking article, an aerosol is produced by the transfer of heat from a combustible or chemical heat source to a physically separate aerosol forming substrate, which may be located within, around or downstream of the heat source.

The term "aerosol-generating article" is used herein to refer to heated smoking articles or smoking articles that are not cigarettes, cigars, cigarillos, or that combust a tobacco substrate to produce smoke. Smoking articles according to the invention may be whole, assembled smoking devices or components of smoking devices that are combined with one or more other components in order to provide an assembled device for producing an aerosol, such as for example, the consumable part of a heated smoking device or aerosol-generating article.

Typically, an aerosol-generating device comprises: a heat source; an aerosol-forming substrate (such as a tobacco substrate); at least one air inlet downstream of the aerosol-forming substrate; and an airflow pathway extending between the at least one air inlet and the mouth-end of the article. The heat source is preferably upstream from the aerosol-forming substrate. In many embodiments, the heat source is integral with the aerosol-generating device and a consumable aerosol-generating article is releasably received within the aerosol-generating device.

The heat source may be a combustible heat source, a chemical heat source, an electrical heat source, a heat sink or any combination thereof. The heat source may be an electrical heat source, preferably shaped in the form of a blade that may be inserted into the aerosol-forming substrate. Alternatively, the heat source may be configured to surround the aerosol-forming substrate, and as such may be in the form of a hollow cylinder, or any other such suitable form. Alternatively, the heat source is a combustible heat source. As used herein, a combustible heat source is a heat source that is itself combusted to generate heat during use, which unlike a cigarette, cigar or cigarillo, does not involve combusting the tobacco substrate in the smoking article. Preferably, such a combustible heat source comprises carbon and an ignition aid, such as a metal peroxide, superoxide, or nitrate, wherein the metal is an alkali metal or alkaline earth metal.

Preferably, the capsule is incorporated into a mouthpiece of a smoking article comprising an aerosol forming substrate that is configured to be heated by an electric heating element of the smoking article to an extent sufficient to produce an aerosol without combusting the aerosol generating substrate. The smoking article may include an aerosol cooling element and a supporting element between the mouthpiece and the aerosol generating substrate. For example, the aerosol generating article may be an aerosol generating article as described in International (PCT) Patent Application Publication WO 2013/098405.

The tobacco substrate or other aerosol-generating substrate used in heated smoking articles or aerosol-generating articles generally includes a higher level of humectant(s) than combusted smoking articles, such as cigarettes. Suitable humectants are known in the art and include, sugar alcohols, sugar polyols, polymeric polyols, glycols, urea, and alpha-hydroxy acids. For example, humectants may include glycerol, glycerol triacetate, triethyl citrate, polyethylene glycol (PEG, such as $PEG_{400}$ and $PEG_{600}$), polyoxyethylene, maltitol, xylitol, sorbitol, propylene glycol, hexylene glycol, butylene glycol, triethylene glycol, and polydextrose.

In various embodiments, the tobacco substrate or aerosol-forming substrate has a high level of humectant. As used herein, a high level of humectant means humectant content that is greater than about 10% or preferably greater than about 15% or more preferably greater than about 20%, by weight on a dry weight basis. The tobacco substrate or aerosol-forming substrate may also have a humectant or aerosol former content of between about 10% and about 30%, from about 15% and about 30%, or from about 20% and about 30%, by weight on a dry weight basis.

The features described above in relation to one aspect of the invention may also be applicable to another aspect of the invention.

All scientific and technical terms used herein have meanings commonly used in the art unless otherwise specified. The definitions provided herein are to facilitate understanding of certain terms used frequently herein.

The terms "upstream" and "downstream" refer to relative positions of elements of the smoking article described in relation to the direction of mainstream smoke or aerosol as it is drawn from a tobacco substrate or aerosol-generating substrate and through the and mouthpiece.

The term "mainstream smoke" is used herein to indicate smoke produced by combustible smoking articles, such as cigarettes, and aerosols produced by non-combustible smoking articles as described above. Mainstream smoke flows through the smoking article and is consumed by the user.

The term "hydrophobic" refers to a surface exhibiting water repelling properties. To determine whether a capsule is made hydrophobic in accordance with the present disclosure, the amount of water absorbed by the capsule and an untreated capsule over a defined period of time under defined conditions may be compared. If the treated capsule absorbs less water, the capsule may be considered to be more hydrophobic than the untreated capsule. For example, the Cobb water absorption test (ISO535:1991) may be modified to apply to capsules to determine the amount of water absorbed by the capsules.

The term 'burst strength' refers to the force exerted on the capsule (when it is the outside of the smoking article) at which the capsule will burst. The burst strength is indicated by a peak in the capsule's force versus compression curve. This may be tested by using a suitable measuring device known in the art, such as an Alluris type FMI—220 C2—digital force gauge 0-200N (commercially available from Alluris Gmbh & Co. KG, Germany).

The term 'diameter of the capsule' refers to the longest cross-sectional dimension of the capsule when measured perpendicular to the longitudinal direction of the filter or smoking article.

As used in this specification and the appended claims, the singular forms "a", "an", and "the" encompass embodiments having plural referents, unless the content clearly dictates otherwise.

As used in this specification and the appended claims, the term "or" is generally employed in its sense including "and/or" unless the content clearly dictates otherwise.

As used herein, "have", "having", "include", "including", "comprise", "comprising" or the like are used in their open-ended sense, and generally mean "including, but not limited to". It will be understood that "consisting essentially of", "consisting of", and the like are subsumed in "comprising," and the like.

The words "preferred" and "preferably" refer to embodiments of the invention that may afford certain benefits under certain circumstances. However, other embodiments may also be preferred under the same or other circumstances. Furthermore, the recitation of one or more preferred embodiments does not imply that other embodiments are not useful, and is not intended to exclude other embodiments from the scope of the disclosure, including the claims.

The invention will be further described, by way of example only, with reference to the accompanying drawings in which FIG. 1 is a schematic drawing of a perspective view of an embodiment of a smoking article, in this case a cigarette, with an unrolled wrapper;

Figure 1:
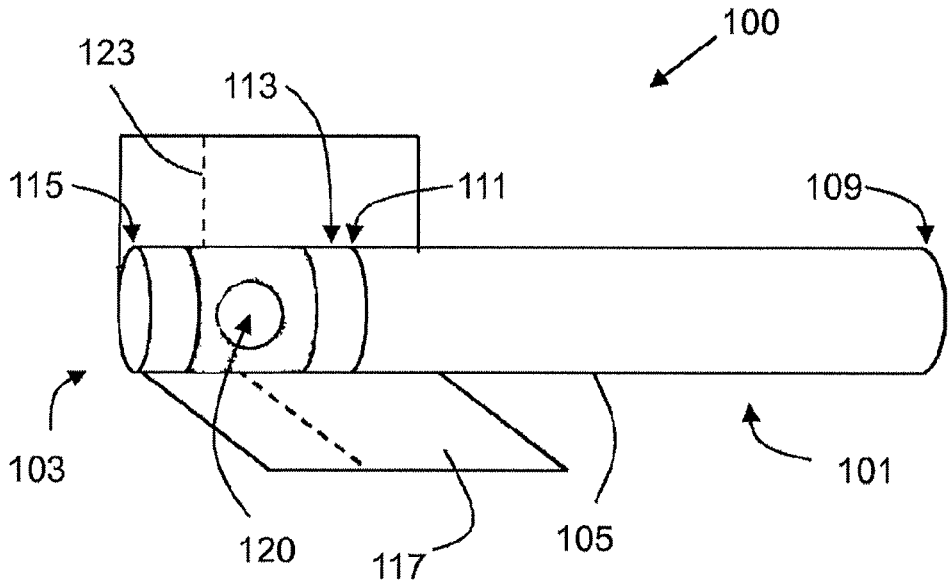

The smoking article 100 depicted in FIG. 1 includes an aerosol forming substrate in the form of a generally cylindrical tobacco rod 101 and a mouthpiece in the form of a generally cylindrical filter 103. The tobacco rod 101 and filter 103 are axially aligned in an end-to-end relationship, preferably abutting one another. The tobacco rod 101 includes an outer wrapper 105 circumscribing the smoking material. The tobacco is preferably a shredded tobacco or tobacco cut filler. The filter 103 includes a filter wrapper (not shown) circumscribing the filter material. The tobacco rod 101 has an upstream, lit end 109 and a downstream end 111. The filter 103 has an upstream end 113 and a downstream, mouth end 115. The upstream end 113 of the filter 103 is adjacent the downstream end 111 of the tobacco rod 101. A breakable capsule 120 containing a liquid flavorant is disposed in a cavity of the filter 103.

The filter 103 is attached to the tobacco rod 101 by tipping material 117 which circumscribes the entire length of the filter 103 and an adjacent region of the tobacco rod 101. The tipping material 117 is shown partially removed from the smoking article in FIG. 1, for clarity. In this embodiment, the tipping material 117 also includes a circumferential row of perforations 123. The perforations 123 are provided for ventilation of the mainstream smoke.

Figure 2:
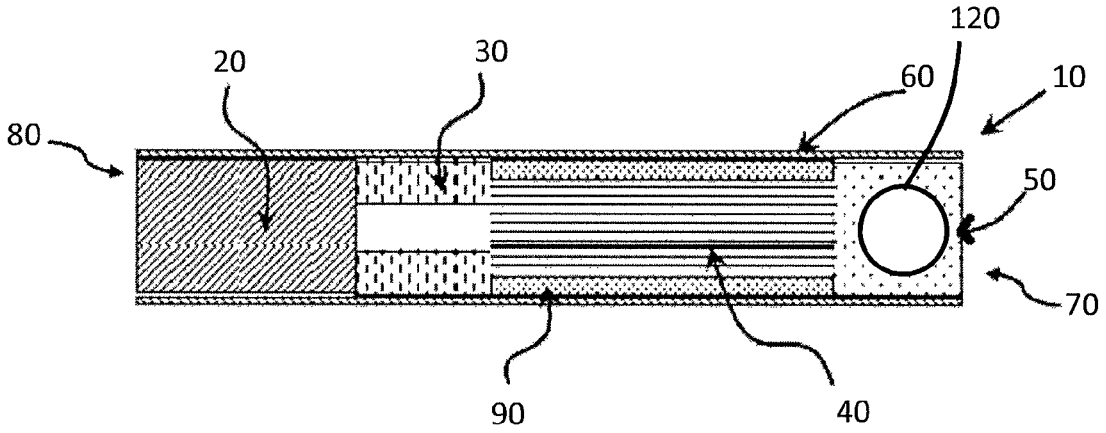
FIG. 2 is a schematic cross-sectional diagram of an embodiment of a smoking article comprising a mouthpiece that includes a capsule.

FIG. 2 illustrates a smoking article 10 according to a preferred embodiment. The smoking article 10 comprises four elements arranged in coaxial alignment: an aerosol-forming substrate 20, a support element 30, an aerosol-cooling element 40, and a mouthpiece 50. These four elements are arranged sequentially and are circumscribed by an outer wrapper 60 to form the smoking article 10. The smoking article 10 has a proximal or mouth end 70, which a user inserts into his or her mouth during use, and a distal end 80 located at the opposite end of the smoking article 10 to the mouth end 70. A breakable capsule 120 containing a liquid flavorant is disposed in the mouthpiece 50.

In use air is drawn through the smoking article 10 by a user from the distal end 80 to the mouth end 70. The distal end 80 of the smoking article may also be described as the upstream end of the smoking article 10 and the mouth end 70 of the smoking article 10 may also be described as the downstream end of the smoking article 10. Elements of the smoking article 10 located between the mouth end 70 and the distal end 80 may be described as being upstream of the mouth end 70 or, alternatively, downstream of the distal end 80.

The aerosol-forming substrate 20 is located at the extreme distal or upstream end of the smoking article 10. In the embodiment illustrated in FIG. 2, aerosol-forming substrate 20 comprises a gathered sheet of crimped homogenised tobacco material circumscribed by a wrapper. The crimped sheet of homogenised tobacco material comprises comprising glycerine as an aerosol-former.

The support element 30 is located immediately downstream of the aerosol-forming substrate 20 and abuts the aerosol-forming substrate 20. In the embodiment shown in FIG. 2, the support element is a hollow cellulose acetate tube. The support element 30 locates the aerosol-forming substrate 20 at the extreme distal end 80 of the smoking article 10 so that it can be penetrated by a heating element of an aerosol-generating device. As described further below, the support element 30 acts to prevent the aerosol-forming substrate 20 from being forced downstream within the smoking article 10 towards the aerosol-cooling element 40 when a heating element of an aerosol-generating device is inserted into the aerosol-forming substrate 20. The support element 30 also acts as a spacer to space the aerosol-cooling element 40 of the smoking article 10 from the aerosol-forming substrate 20.

The aerosol-cooling element 40 is located immediately downstream of the support element 30 and abuts the support element 30. In use, volatile substances released from the aerosol-forming substrate 20 pass along the aerosol-cooling element 40 towards the mouth end 70 of the smoking article 10. The volatile substances may cool within the aerosol-cooling element 40 to form an aerosol that is inhaled by the user. In the embodiment illustrated in FIG. 2, the aerosol-cooling element comprises a crimped and gathered sheet of polylactic acid circumscribed by a wrapper 90. The crimped and gathered sheet of polylactic acid defines a plurality of longitudinal channels that extend along the length of the aerosol-cooling element 40.

The mouthpiece 50 is located immediately downstream of the aerosol-cooling element 40 and abuts the aerosol-cooling element 40. In the embodiment illustrated in FIG. 2, the mouthpiece 50 comprises a conventional filter material, such as cellulose acetate tow filter of low filtration efficiency.

A distal end portion of the outer wrapper 60 of the smoking article 10 may circumscribed by a band of tipping paper (not shown).

The smoking article 10 illustrated in FIG. 2 is designed to engage with an aerosol-generating device comprising a heating element in order to be consumed by a user. In use, the heating element of the aerosol-generating device heats the aerosol-forming substrate 20 of the smoking article 10 to a sufficient temperature to form an aerosol, which is drawn downstream through the aerosol-generating article 10 and inhaled by the user. The user may squeeze the mouthpiece 50 to cause the capsule 120 to break and release flavorant at any desired time during consumption of the article 10. The flavorant may be entrained in air carrying the aerosol and may be inhaled by the user along with the aerosol.

Figure 3:
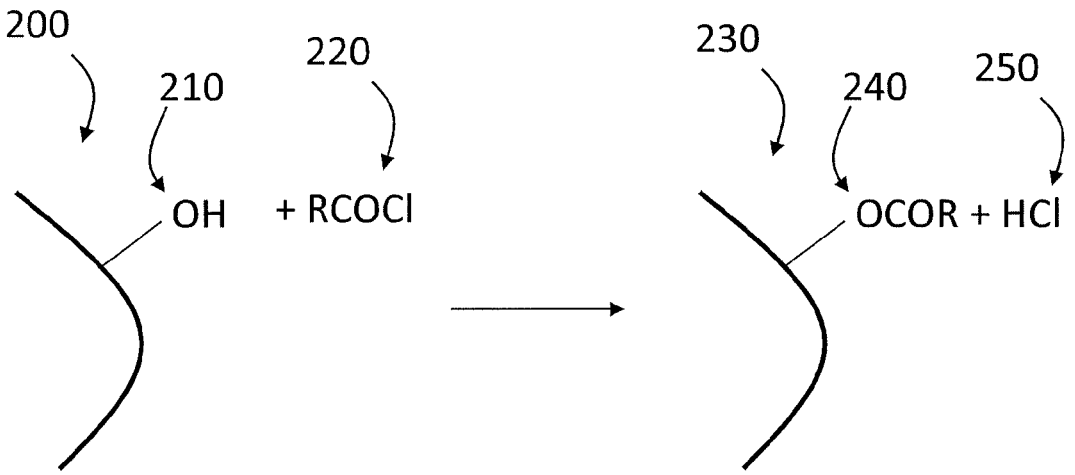
FIG. 3 is a schematic drawing illustrating an embodiment of reaction to graft a hydrophobic moiety to a hydrophilic surface.

An example of a reaction to convert a hydrophilic surface 200 of a capsule to a hydrophobic surface 230 is shown in FIG. 3. The hydrophilic surface 200 includes pendant hydroxyl moieties 210 in the illustrated embodiment. A fatty acid chloride (RCOCl) 220 hydrophobic reagent may be reacted with the pendant hydroxy moiety 210 to produce a hydrophobic surface 230 having a pendant fatty acid moiety 240. Hydrochloric acid (HCl) 250 is a by-product of the reaction.

EXAMPLES

Example 1: Initial Proof of Concept

The effectiveness of hydrophobic treatment of a surface of a capsule was tested.

Capsules containing a menthol core and a shell composed mainly of gelatin were obtained from V. Mane Fils (France) and immersed in a solution containing palmitic acid chloride, a $C_{16}$ fatty acid chloride, dissolved in petroleum ether (a nonprotic polar solvent). The capsules were allowed to dry in air after a brief immersion, and were then placed under an oven at 80-100C for 2-8 minutes.

Figure 4:
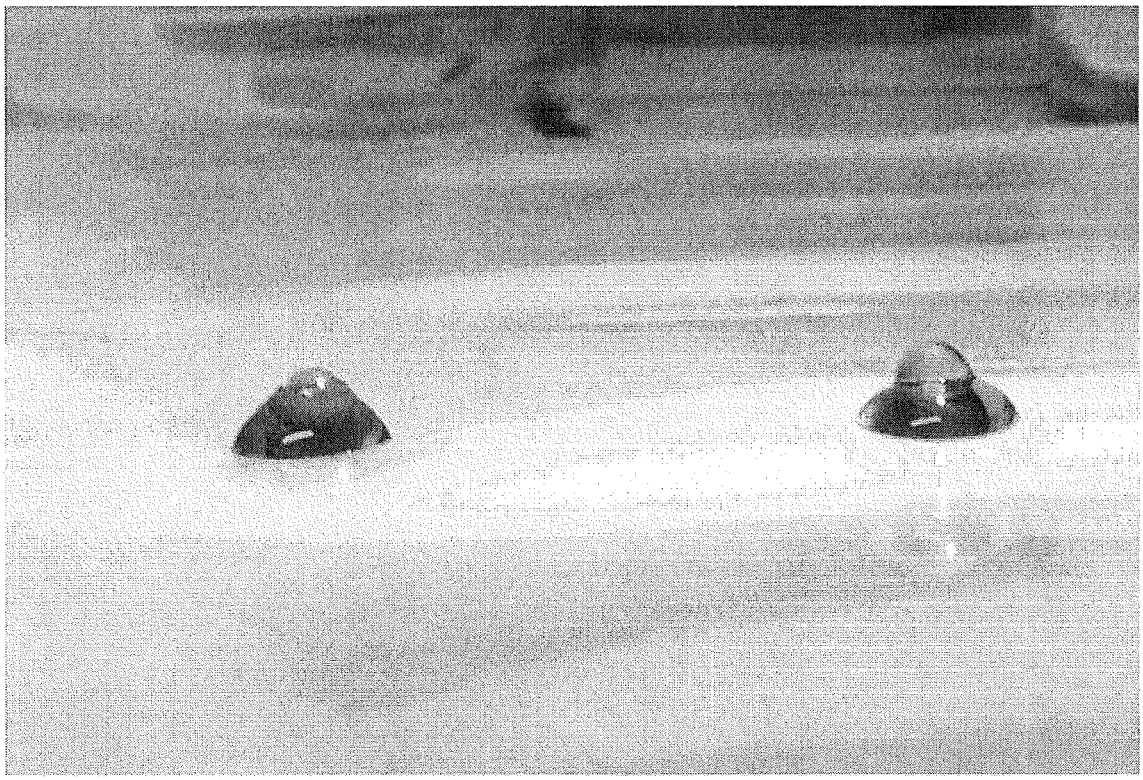
FIG. 4 is a photograph of untreated (left) and hydrophobic-treated (right) capsules taken a few minutes after a drop of water was placed on the capsules.

An untreated (as obtained by V. Mane Fils) and a hydrophobic-treated capsule were placed on a flat plane. On each of the surface of the hydrophobic-treated and the untreated capsule was placed a drop of water. A photograph (FIG. 4) of the capsules was taken a few minutes after the drops of water were placed on the capsules. In FIG. 4, the untreated capsule is on the left and the hydrophobic-treated capsule is shown on the right. The thickness of the wall of the untreated capsule increased from 50-100 micrometers to several fold thicker. The hydrophobic-treated capsule did not swell and the water drop maintained its overall original shape on the flat plane after a few minutes.

As evident from FIG. 4, the hydrophobic treatment of the capsule resulted in a different response to water. The treatment was effective in reducing the amount of water absorbed by the treated capsule relative to the untreated capsule.

Example 2: Additional Trials

I. Materials and Methods

A. $C_{16}$ Fatty Acid Chloride Grafting

Spherical capsules with a shell comprising gelatin and a menthol-containing core [V. Mane Fils (France)] having a diameter of about 2 mm to about 3 mm (menthol) ("Menthol capsules") and Viscopearl (roughly spherical objects made of viscose and having a diameter of about 1 mm (Rengo) were grafted with palmitic acid chloride, a $C_{16}$ fatty acid chloride ($C_{16}$ FAC), using three grafting techniques to determine which grafting techniques may work well to produce capsules with a hydrophobic shell. The grafting reacts the FACs with hydroxyl groups present on the surface of the shells of the capsules to covalently bond the fatty acid to the shell. The by-product of the reaction is hydrochloric acid, which is evacuated.

The three grafting techniques employed are outlined below:

1. Oven

A reagent mix solution was prepared by introducing the $C_{16}$ FAC (2% by weight) in a solvent (petroleum ether, 98%). The capsules were immersed in the reagent mix solution for a few minutes and removed from the reagent mix solution. The residual solvent was evaporated from the capsules at room temperature for a few minutes. The capsules were then placed in an oven, which was kept under nitrogen flux at 850 mbar pressure and at a temperature of 150° C. for the time indicated below in Table 1, or kept under atmospheric conditions at a temperature of 150° C. for the time indicated below in Table 1.

2. Heat Gun

A reagent mix solution was prepared by introducing the $C_{16}$ FAC (2% by weight) in a solvent (petroleum ether, 98%). The capsules were immersed in the reagent mix solution for a few minutes and removed from the reagent mix solution. The residual solvent was evaporated from the capsules at room temperature for a few minutes. The $C_{16}$ FAC was grafted to the capsule surface by directing a heat gun set at a temperature of 150° C. at the capsules for the time indicated below in Table 1.

3. Vapor Phase

The $C_{16}$ FAC was placed in a Petri dish having a grill paced on top. The capsules were placed on top of the grill. The Petri dish with grill and capsules on top were placed in a desiccator, which was placed in an oven at 180° C. for the time indicated below in Table 1. For the vapor phase trials, the oven was set at 180° C. to reach 150° C. in the reactor more rapidly.

TABLE 1

| | $C_{16}$ Grafting Conditions | | | | | | | |
|---|---|---|---|---|---|---|---|---|
| | 2 min | 4 min | 5 min | 8 min | 10 min | 15 min | 20 min | 30 min |
| Oven 150° C. | Both | Both | | Both | | | | |
| Heat Gun 150° C. | Both | Both | | Both | | | | |

TABLE 1-continued

| | $C_{16}$ Grafting Conditions | | | | | | | |
|---|---|---|---|---|---|---|---|---|
| | 2 min | 4 min | 5 min | 8 min | 10 min | 15 min | 20 min | 30 min |
| Vapor Phase 180° C. | | | Both | | Viscopearl | Menthol | Both | Viscopearl |

B. $C_{11}$ Fatty Acid Chloride Grafting

Menthol capsules and Viscopearl were grafted with a $C_{11}$ fatty acid chloride ($C_{11}$ FAC) using three grafting techniques to determine which grafting techniques may work well to produce capsules with a hydrophobic shell. The grafting reacts the fatty acid chlorides with hydroxyl groups present on the surface of the shells of the capsules to covalently bond the fatty acid to the shell. The by-product of the reaction is hydrochloric acid, which is evacuated.

The three grafting techniques employed are outlined below:

1. Oven

A reagent mix solution was prepared by introducing the $C_{11}$ FAC (2% by weight) in a solvent (petroleum ether, 98%). The capsules were immersed in the reagent mix solution for a few minutes and removed from the reagent mix solution. The residual solvent was evaporated from the capsules at room temperature for a few minutes. The capsules were then placed in an oven, which was kept under nitrogen flux at 850 mbar pressure and at a temperature of 80° C. for the time indicated below in Table 2, or kept under atmospheric conditions at a temperature of 80° C. for the time indicated below in Table 2.

2. Heat Gun

A reagent mix solution was prepared by introducing the $C_{11}$ FAC (2% by weight) in a solvent (petroleum ether, 98%). The capsules were immersed in the reagent mix solution for a few minutes and removed from the reagent mix solution. The residual solvent was evaporated from the capsules at room temperature for a few minutes. The $C_{11}$ FAC was grafted to the capsule surface by directing a heat gun set at a temperature of 80° C. at the capsules for the time indicated below in Table 2.

3. Vapor Phase

The $C_{11}$ FAC was placed in a Petri dish having a grill placed on top. The capsules were placed on top of the grill. The Petri dish with grill and capsules on top were placed on a ring of blotter paper, which were placed in an oven at the temperatures and times indicated below in Table 2.

TABLE 2

| | $C_{11}$ Grafting Conditions | | | |
|---|---|---|---|---|
| | 4 min | 8 min | 10 min | 20 min |
| Oven 80° C. | | | Menthol | |
| Heat Gun 80° C. | Both | Both | | Menthol |
| Vapor 80° C. | Both | Both | | Menthol |
| Vapor 100° C. | | | | Menthol |
| Vapour 120° C. | | | | Menthol |

C. Immersion in Water

The grafted capsules were placed in water and their behaviour was observed. For example, the general appearance of the capsules was noted, the percent of capsules that floated was noted, and the time to discoloration of menthol capsules was noted.

D. Measurement of Gradual Weight Gain when Placed in a Tropical Environment

The grafted capsules were placed in a controlled environment ("Tropical environment") at 38° C. and 90% relative humidity, and their mass was measured at predetermined times to determine the amount of weight they gained due to moisture absorption.

E. Measurement of Surface Tension

Surface tension measurement was performed only on the Menthol capsules. Due to the smaller size of the Viscopearl, surface tension measurements were not taken for the Viscopearl. The Menthol capsules were put on a small rod using adhesive tape, and the test was carried out with Kruss equipment with a custom geometry (cylinder of 3 mm diameter and 3 mm height), and an immersion depth of 1.5 mm, for a duration of 60 s. The absolute mass of water taken up by the capsule was measured. The experiment is designed to estimate the effectiveness of the grafting, where the lower the mass, the more effective was the grafting.

F. Measurement of Color Leaking

The amount of colorant that was leaked from the menthol capsules was measured using UV-VIS spectrophotometry. For each sample, 3 capsules were put in an appropriate spectrophotometer measurement cell in distilled water, and the absorbance was measured at 286 nm after 1 min.

II. Results

Several observations were made following the $C_{16}$ FAC trials. Some initial observations are presented below in Table 3 (for Menthol capsules) and Table 4 (for Viscopearl).

TABLE 3

| Observations for Menthol Capsules<br>Menthol Capsules | |
|---|---|
| Oven 150° C. | The capsules were whitened when coming out of the oven. There was a slight difference with ungrafted samples (which started discolorating after 8-9 s in water) when put in water: discoloration was not slower (~10 s), but seemed less important<br>The grafting did not seem efficient: the capsules did not particularly repel water and did seem to float better than ungrafted capsules. |
| Heat Gun 150° C. | The capsules were also whitened after heating, especially after 4 min. They regained their green color after 8 min of heating.<br>After 2 min of heating, the capsules still looked wet, which was likely due to some petroleum ether remaining. When put into water, discoloration started after about 12 s (2 min of heating) or 17 s (4 and 8 min of heating). The capsules seemed grafted, with better results when put in water (less discoloration and better floating) after 4 and 8 min of grafting. |
| Vapor Phase 180° C. | With this technique, the capsules do not whiten. But time may be important for this process: after 5 min, the capsules were not grafted (no difference when put in water), and after 20 min, they did not keep their integrity when cooling down (bursting) and as a result were covered in menthol. |

TABLE 3-continued

| Observations for Menthol Capsules<br>Menthol Capsules |
|---|
| However after 15 min, the capsules were still solid, not whitened, and could spend around 40 s in water before discoloration started, with better floating. |

TABLE 4

| Observations for Viscopearl<br>Viscopearl | |
|---|---|
| Oven 150° C. | The Viscopearl seemed whiter when they came out of the oven, especially at 2 and 4 min of grafting. Under 8 min spent in the oven, they tended to agglomerate and still look humid, with petroleum ether remaining. After 8 min of grafting, the grafted Viscopearl looked like the ungrafted Viscopearl. When put in water, the Viscopearls sank almost immediately; grafting did not seem efficient. |
| Heat Gun 150° C. | The Viscopearl were close in aspect to the ungrafted capsules. Some (less than with the oven method) solvent appeared to remain after grafting. There was a clear difference between ungrafted and grafted samples, with grafted samples floating in water (some still sink), and less sample sinking with grafting time rising (from about 70/30 to 90/10, in %). |
| Vapor Phase 180° C. | Again, time was clearly critical for this process: the longer the Viscopearl remained in the oven, the blacker they come out. Unexpectedly grafting did not seem to work with this method on these Viscopearl: they sank in water whatever grafting time is used. |

In general the grafting of the $C_{16}$ FAC was observed to be more effective than the grafting of the $C_{11}$ FAC regarding reaction to water, such as increased floating and less color leaking.

Capsules were observed to degrade when exposed to elevated temperatures for extended periods of time. Even at 80° C., the capsules degraded when they remained exposed too long.

There was no difference observed between weight gain in capsules that were not grafted and grafted capsules placed at 38° C. and 90% RH.

The results of immersing the Viscopearl into water are detailed in Table 5 below.

TABLE 5

| Results of placing $C_{16}$ FAC grafted Viscopearl into water | | | | | | | |
|---|---|---|---|---|---|---|---|
| Viscopearl with $C_{16}$ | 2 min | 4 min | 5 min | 8 min | 10 min | 20 min | 30 min |
| Oven 150° C., 850 mBar | 50% float 50% sink | 50-60% float 40-50% sink | — | 50-60% float 40-50% sink | — | — | — |
| Heat Gun 150° C. | 70% float 30% sink | 80% float 20% sink | — | 90% float 10% sink | — | — | — |
| Vapor Phase 180° C. | — | — | Sink | — | Sink | Sink | Sink |

All the Viscopearl treated with $C_{11}$ FAC sank when put in water.

For the Menthol capsules, their behaviour in water was easier to quantify due to colorant leaking out after a few seconds of immersion. Table 6 below summarizes the time needed, in seconds, for the leakage of the colorant in the different trials. For a point of comparison, Menthol capsules that were not grafted started to bleed colorant after 8 seconds in water.

TABLE 6

| Time to colorant leaking from $C_{16}$ FAC treated Menthol capsules | | | | | |
|---|---|---|---|---|---|
| | 2 min | 4 min | 5 min | 8 min | 15 min |
| Oven at 150° C. | 8 s | 8 s | — | 11 s | — |
| Heat gun at 150° C. | 12 s | 18 s | — | 18 s | — |
| Vapor phase 180° C. | — | — | 8 s | — | 40 s |

Figure 5:
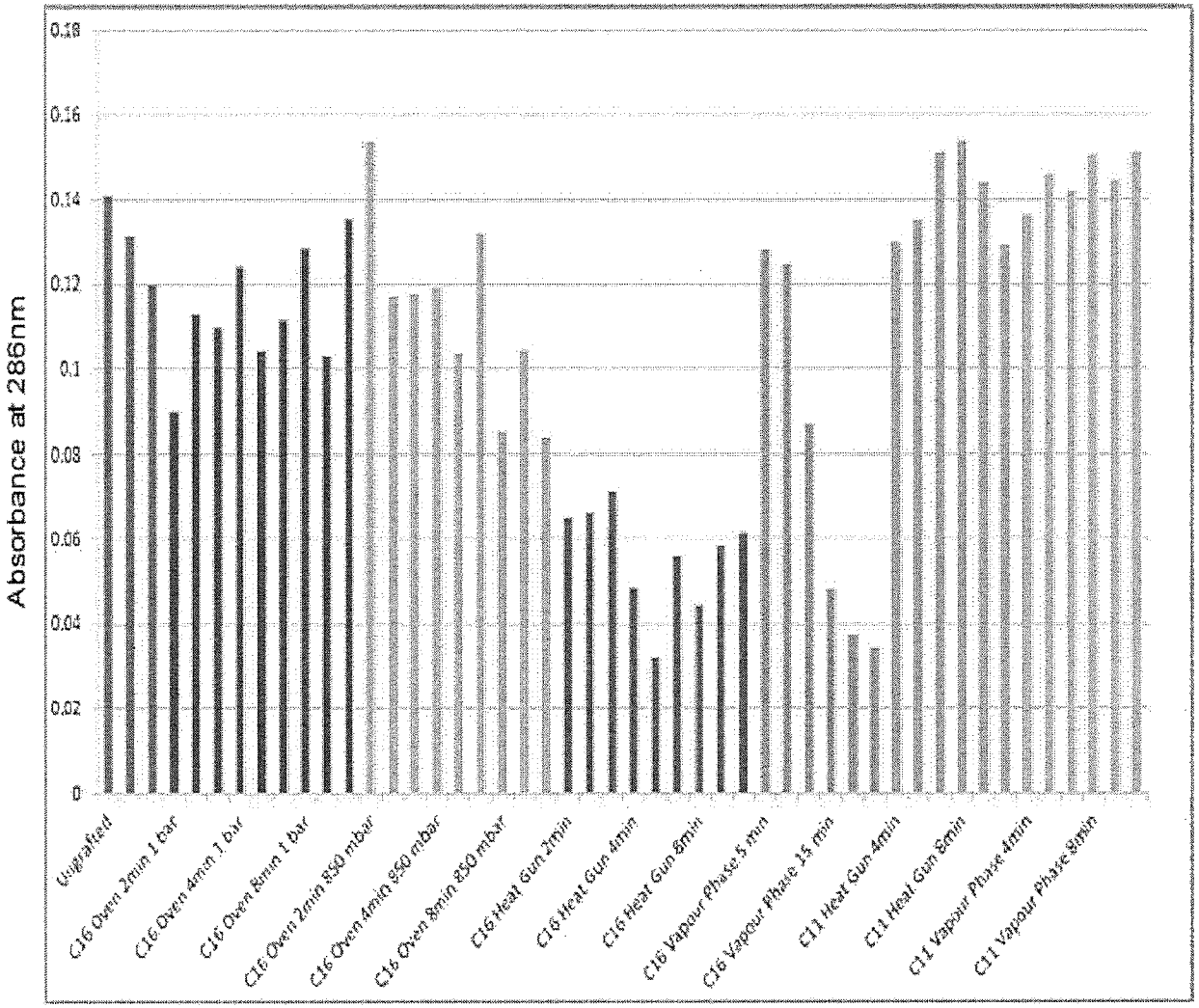
FIG. 5 is a graph of UV absorption of capsule grafted under various conditions.

The UV absorption results (to test the amount of colorant that leaked) presented in FIG. 5 confirm the previous observations: grafting in the oven slightly improves resistance to water, while grafting with the heat gun or for a long enough time in vapor phase clearly improves resistance to water. For these conditions, the colorant bleeds much slower, resulting in a lower value in absorbance measurement.

Table 7 below provides the mass measured over time (two measurements per condition). In theory, the lower the mass, the better the grafting.

TABLE 7

Mass taken up by the Menthol capsules in surface tension tests

| Time (s) | Ungrafted | C16 Oven 2 min 1 bar | C16 Oven 4 min 1 bar | C16 Oven 8 min 1 bar | C16 Oven 2 min 850 mBar | C16 Oven 4 min 850 mbar | C16 Oven 8 min 850 mbar | C16 Heat Gun 2 min | C16 Heat Gun 2 min |
|---|---|---|---|---|---|---|---|---|---|
| 1 | 61.8 | 80.7 | 81.5 | 61.6 | 18.8 | 16.4 | 15.3 | 117.7 | 17.5 |
| 7 | 62.2 | 81.3 | 82.0 | 62.4 | 18.9 | 16.4 | 15.4 | 117.9 | 17.2 |
| 14 | 62.8 | 81.8 | 82.6 | 63.4 | 19.0 | 16.5 | 15.4 | 118.7 | 16.9 |
| 21 | 63.4 | 82.3 | 83.0 | 63.9 | 19.1 | 16.6 | 15.7 | 119.2 | 16.8 |
| 27 | 63.7 | 82.6 | 83.2 | 64.2 | 19.1 | 16.6 | 15.8 | 119.5 | 16.6 |
| 34 | 64.1 | 82.7 | 83.5 | 64.4 | 19.2 | 16.7 | 15.9 | 120.0 | 16.4 |
| 41 | 64.4 | 83.0 | 83.8 | 64.6 | 19.2 | 16.7 | 16.0 | 120.3 | 16.3 |
| 47 | 64.6 | 83.2 | 84.0 | 64.7 | 19.3 | 16.7 | 16.1 | 120.7 | 16.2 |
| 54 | 64.9 | 83.4 | 84.2 | 64.9 | 19.3 | 16.7 | 16.1 | 121.0 | 16.0 |
| 60 | 65.1 | 83.5 | 84.4 | 65.0 | 19.4 | 16.7 | 16.1 | 121.1 | 15.9 |

| Time (s) | C16 Heat Gun 8 min | C16 Vapor phase 5 min | C16 Vapor phase 15 min | C11 Oven 10 min 850 mBar | C11 Heat Gun 4 min | C11 Heat Gun 8 min | C11 Vapor phase 80° C. 20 min | C11 Vapor phase 1000° C. 20 min |
|---|---|---|---|---|---|---|---|---|
| 1 | 46.7 | 63.1 | 63.1 | 58.2 | 80.9 | 80.6 | 64.2 | 62.4 |
| 7 | 46.5 | 63.5 | 63.4 | 58.1 | 81.6 | 81.2 | 64.8 | 62.7 |
| 14 | 46.5 | 63.9 | 63.5 | 58.2 | 82.3 | 81.8 | 65.2 | 63.2 |
| 21 | 46.3 | 64.3 | 63.7 | 58.2 | 82.7 | 82.4 | 65.5 | 63.5 |
| 27 | 46.2 | 64.6 | 63.7 | 58.4 | 83.1 | 82.6 | 65.9 | 63.6 |
| 34 | 46.2 | 65.0 | 63.8 | 58.5 | 83.4 | 83.0 | 66.1 | 63.8 |
| 41 | 46.2 | 65.2 | 63.8 | 58.6 | 83.7 | 83.3 | 66.4 | 64.0 |
| 47 | 46.3 | 65.4 | 63.8 | 58.6 | 83.9 | 83.5 | 66.6 | 64.1 |
| 54 | 46.3 | 65.6 | 63.9 | 58.7 | 84.1 | 83.8 | 66.7 | 64.2 |
| 60 | 46.3 | 65.8 | 63.9 | 58.7 | 84.3 | 84.0 | 66.8 | 64.4 |

Figure 6:
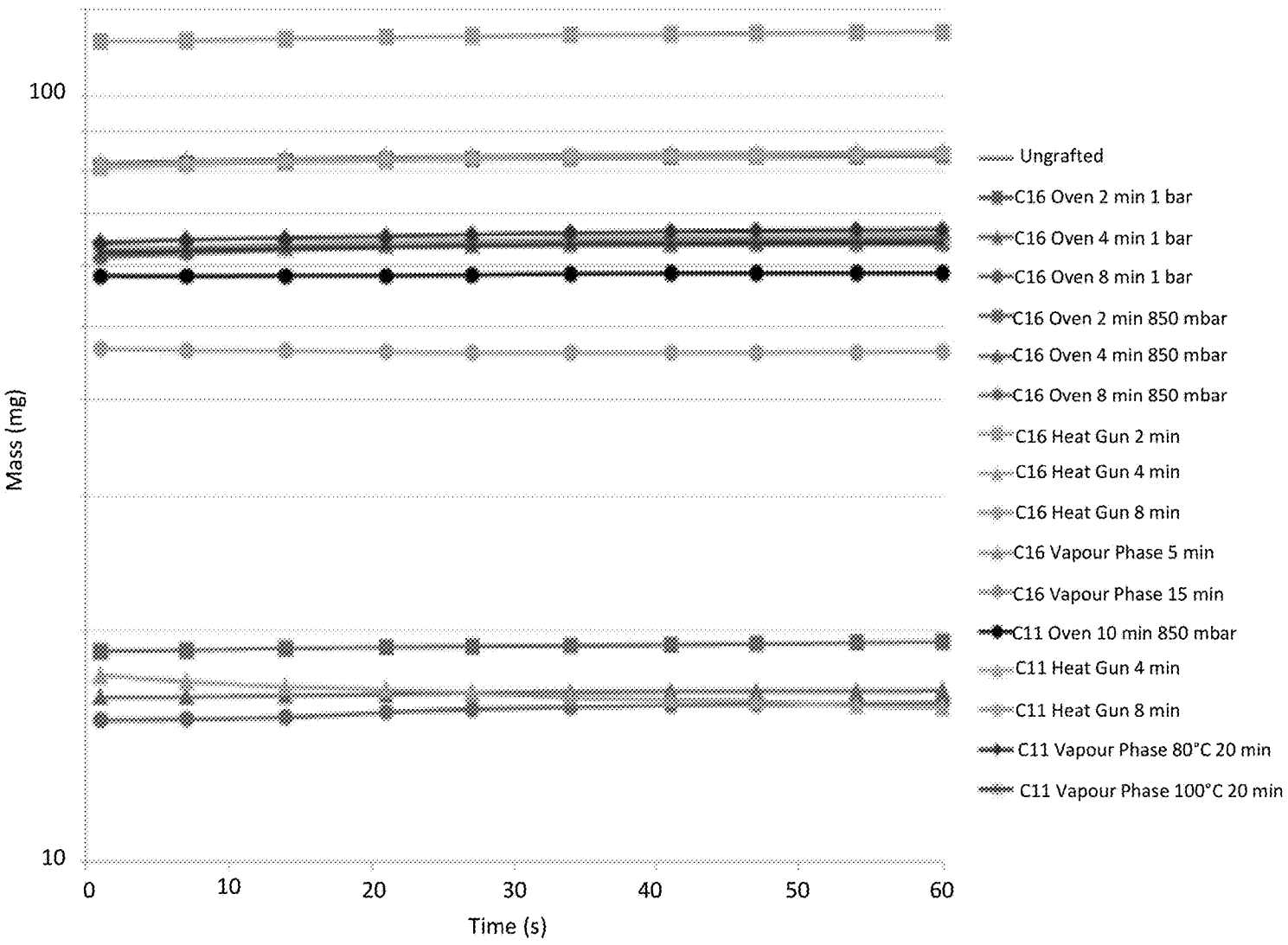
FIG. 6 is a graph of mass taken up by menthol capsules, which were grafter under various conditions, in surface tension tests.

FIG. 6 presents the results from Table 7 in graphical form. As indicated, surface tension measurements appear to suggest that grafting using a heat gun for 4 minutes and grafting in the oven resulted in less water absorption by the capsules.

From surface tension measurements alone we would deduce that grafting in the oven or with the heat gun are better solutions than grafting in vapour phase

III. Conclusion

In conclusion, covalent bonding of fatty acid moieties to the surface of the capsules may be achieved through a number of techniques. For example, covalent bonding under a hot air flow and in vapor phase with pure reagent seems to work well. These techniques may be optimized, improved and scaled up for industrial scale covalent bonding of hydrophobic moieties to surfaces of capsules, e.g. by using a fluidized bed.

Example 3: Sensory Testing

Capsules comprising menthol and having a shell comprising gelatin (V. Mane Fils) ("Menthol capsules") were treated with $C_{16}$ fatty acid chloride to graft a $C_{16}$ fatty acid moiety to the surface of the Menthol capsules using four different processes. The processes were carried out generally as described above in Example 2 and included (i) heat gun treatment at 150° C. for 8 minutes; (ii) oven at 150° C. for 8 minutes; (iii) oven at 150° C. for 4 minutes; and (iv) vapor phase at 180° C. for 4 minutes.

The Menthol capsules were incorporated into the filter of prototypes of a smoking article comprising a rod of crimped cast leaf tobacco and a filter comprising a segment of cellulose acetate tow (similar to HEETS™. Nine panellists tested three different samples of each prototype (containing a capsule treated using a different process) over four sessions. In each session, the panellists tested three prototypes, each containing a Menthol capsule that underwent the same treatment protocol. Panellists consumed the smoking articles containing treated Menthol capsules using a iQOS-branded tobacco heating device and provided their sensory perception regarding the leaking of flavour (minty/cooling sensation), a dull clicking sound when the capsule breaks (the "sound to click") and the tactile sensation of the capsule breaking between the fingers at the end of the test.

To test for leakage of the flavor, the panellists consumed the smoking article (at least ten puffs) and were asked to evaluate whether they perceived a minty aroma, a cooling sensation, or both a minty aroma and a cooling sensation. If they perceived a sensation, the panelists were asked to indicate at what puff the sensation was perceived. At the end of each run, the panellists were asked to try to break the capsule and to tell if they perceived a tactile sensation of capsule breakage and a sound, just a sensation (no sound), or nothing (no sensation and no sound).

Data from one of the panellists for the "sound to click" test were removed from the analysis because the panellist was not pressing where the capsule was located.

Figure 7:
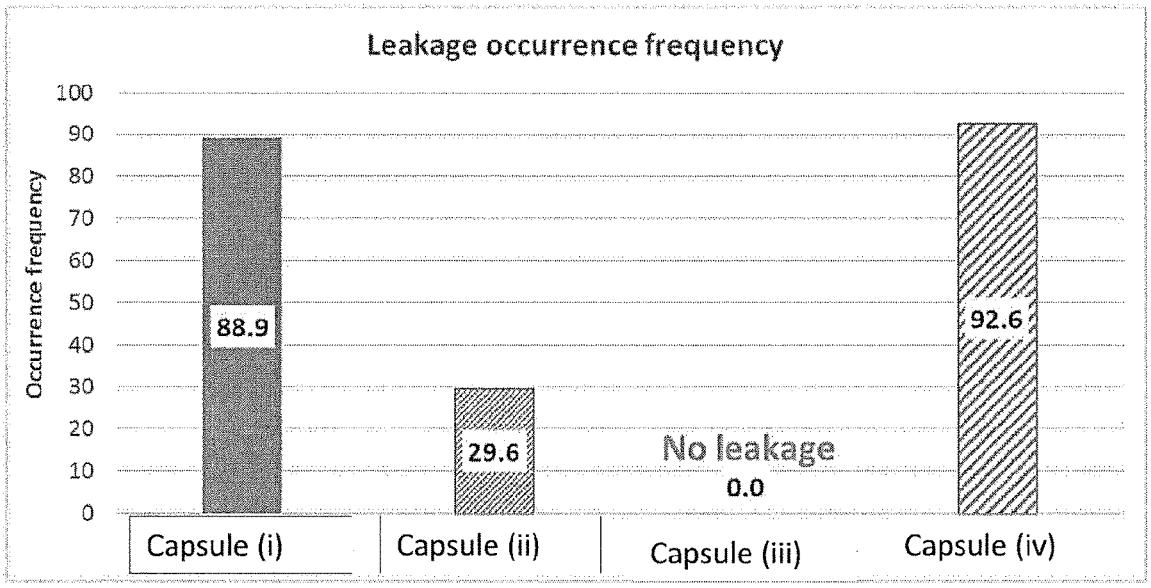
FIG. 7 is a plot of leakage frequency per capsule, where a leakage occurrence was determined by perception by a panelist of perception of a minty aroma or cooling sensation while consuming the smoking article without attempting to break the capsule while consuming the article.
Figure 8:
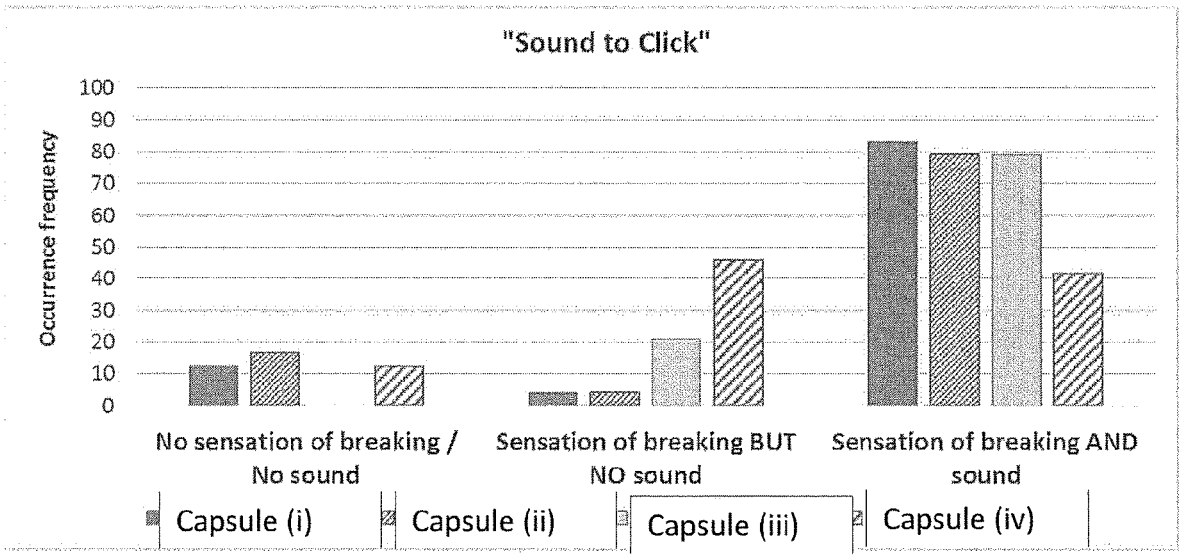
FIG. 8 is a plot of frequency of occurrence of (i) no sensation of breaking and no "clicking" sounds, (ii) sensation of breaking but not "clicking" sound, and (iii) sensation of breaking and "clicking" sound perceived by panelist attempting to break capsule of smoking articles comprising the capsules after the smoking articles were consumed.

Results are presented in FIGS. 7-8. In FIG. 7, a plot of leakage frequency per capsule is shown. Occurrence frequencies were calculated from the results of nine panellists for a total of 27 samples per prototype tested. In FIG. 8, the "sound to click" results are presented. Occurrence frequencies were calculated from the results of eight panellists for a total of 24 samples per prototype tested.

As shown in FIG. 7, while the leakage occurrence frequency was around 90% for both capsules (i) and (iv), only 30% leakages were observed for the capsule (ii) and no leakage was observed for the capsule (iii). Looking at the panellists' comments, we observed that for the three capsules showing leakages [capsules (i), (ii) and (iv)], panellists mentioned that only very low intensity of minty aroma or cooling sensation were perceived. It is possible that very slight leakages of the capsules or even a contamination of the samples occurred prior the evaluation due to capsules already broken or already leaking before the evaluation, which may have contaminated the whole jar of samples. Further analysis is warranted.

In terms of the "sound to click", FIG. 8, capsules (i), (ii) and (iii) obtained very close results with around 80% of the samples still eliciting the tactile sensation and sound to click at the end of the run. For the capsule (iv), we observed lower proportion of the samples maintaining sensation and sound to click at the end of the run, with higher proportion of samples eliciting only sensation but no sound to click.

Example 4: Distance at Break and Resistance to Click

Menthol capsules were grafted with 2% $C_{16}$ fatty acid chloride as described in Example 2 above. The average weight of the Menthol capsules was 21.1 mg (n=50). The Menthol capsules were treated at 150° C. with a heat gun for 4 minutes or 8 minutes, at 150° C. for 8 min under 850 mbar pressure in an oven, or at 150° C. for the vapor phase.

Resistance to click and distance at breakage were determined as follows. Briefly, an Instron universal tensile/compression testing machine equipped with a 100N tension load cell was employed. A lower compression plate having a diameter of 150 mm and an upper compression plate, resistant to the capacity of the load cell, and having a diameter of 20 mm was employed. The Menthol capsules were placed on the center of the lower plate. The upper plate was lowered towards the Menthol capsule and lower plate at about 30 mm/min. The testing was performed at 22° C. under 60 percent relative humidity.

The distance the upper plate moved (in mm, distance at break) after contacting the Menthol capsule and the load (in Newtons, resistance to click) was measured. An abrupt drop in load occurred when the capsules broke.

Results are presented below in Tables 8-11.

TABLE 8

| Heat gun, 4 min | | |
|---|---|---|
| | DaB (mm) | RTC (N) |
| 1 | 0.78 | 18.3 |
| 2 | 0.83 | 18.2 |
| 3 | 0.6 | 18.2 |
| 4 | 0.77 | 18.7 |
| 5 | 0.73 | 16.7 |
| 6 | 0.8 | 20.1 |
| 7 | 0.9 | 23 |
| 8 | 0.76 | 19.4 |
| 9 | 0.78 | 16.5 |
| 10 | 0.77 | 17.8 |
| Average | 0.77 | 18.7 |

TABLE 9

| Heat gun 8 min | | |
|---|---|---|
| | DaB (mm) | RTC (N) |
| 1 | 0.71 | 15.4 |
| 2 | 0.82 | 17.7 |
| 3 | 0.67 | 10.7 |

TABLE 9-continued

| Heat gun 8 min | | |
|---|---|---|
| | DaB (mm) | RTC (N) |
| 4 | 0.68 | 13.7 |
| 5 | 0.81 | 19 |
| 6 | 0.48 | 5.6 |
| 7 | 0.74 | 16.4 |
| 8 | 0.82 | 16.4 |
| 9 | 0.81 | 14.7 |
| 10 | 0.79 | 17.8 |
| Average | 0.73 | 14.7 |

TABLE 10

| Vapor phase | | |
|---|---|---|
| | DaB (mm) | RTC (N) |
| 1 | 0.79 | 14.4 |
| 2 | 1.09 | 25.2 |
| 3 | 1.06 | 22.4 |
| 4 | 0.72 | 20.4 |
| 5 | 0.84 | 16.2 |
| 6 | 0.91 | 17.1 |
| 7 | 0.6 | 15.7 |
| 8 | 0.87 | 16.7 |
| 9 | 0.68 | 12.4 |
| 10 | 0.81 | 14.7 |
| Average | 0.84 | 17.5 |

TABLE 11

| Oven | | |
|---|---|---|
| | DaB (mm) | RTC (N) |
| 1 | 0.7 | 16.9 |
| 2 | 0.95 | 18.3 |
| 3 | 0.92 | 20.2 |
| 4 | 0.71 | 15.9 |
| 5 | 0.99 | 19.9 |
| 6 | 0.65 | 11.1 |
| 7 | 0.75 | 17.1 |
| 8 | 0.45 | 8.2 |
| 9 | 0.81 | 20.1 |
| 10 | 1.21 | 18.2 |
| Average | 0.81 | 16.6 |

CONCLUSIONS

The results show that capsules comprising a flavorant and a breakable shell can be treated by a variety of methods and conditions with an acid chloride comprising a fatty acid moiety. The treated capsules are is resistant to moisture and yet retain much of their performance characteristics when they are compressed to breakage.

The embodiments exemplified above are not limiting. Other embodiments consistent with the embodiments described above will be apparent to those skilled in the art.

Each patent, published patent application, journal article and other publicly available information cited herein is hereby incorporated herein by reference in its respective entirety to the extent that it does not conflict with the disclosure presented herein.

The invention claimed is:

1. A smoking article comprising a capsule and an aerosol forming substrate downstream of the capsule, the capsule comprising:

a liquid sensory enhancing material; and a shell surrounding the liquid sensory enhancing material, the shell having an outer surface rendered hydrophobic by hydrophobic groups covalently bond to the outer surface of the shell.

2. A smoking article according to claim 1, wherein the smoking article comprises a mouthpiece and wherein the mouthpiece comprises the capsule.

3. A smoking article according to claim 2, wherein the mouthpiece comprises filter material, and wherein the capsule is embedded in the filter material.

4. A smoking article according to claim 1, wherein the article is configured to heat but not combust the aerosol forming substrate.

* * * * *